US008320813B2

(12) United States Patent
Miyazaki

(10) Patent No.: US 8,320,813 B2
(45) Date of Patent: Nov. 27, 2012

(54) IMAGE FORMING APPARATUS, IMAGE FORMING SYSTEM, IMAGE FORMING METHOD AND COMPUTER READABLE MEDIUM STORING PROGRAM

(75) Inventor: Masaya Miyazaki, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1064 days.

(21) Appl. No.: 12/260,550

(22) Filed: Oct. 29, 2008

(65) Prior Publication Data

US 2009/0245818 A1 Oct. 1, 2009

(30) Foreign Application Priority Data

Mar. 28, 2008 (JP) ..... 2008-085583

(51) Int. Cl.
*G03G 15/00* (2006.01)
*G03G 21/00* (2006.01)

(52) U.S. Cl. ..... 399/381; 399/361; 399/391; 399/392

(58) Field of Classification Search ..... 399/361, 399/363, 381, 391–392
See application file for complete search history.

(56) References Cited

U.S. PATENT DOCUMENTS 4,914,454 A * 4/1990 Tadauchi et al. ..... 347/153
5,158,276 A * 10/1992 Toma ..... 271/9.11
6,285,844 B1 * 9/2001 Kuga ..... 399/85
2002/0051666 A1 * 5/2002 Asai et al. ..... 399/391
2002/0118975 A1 * 8/2002 Asai ..... 399/45
2005/0044550 A1 * 2/2005 Perdu ..... 718/105
2009/0175633 A1 * 7/2009 Shimizu ..... 399/12

FOREIGN PATENT DOCUMENTS

JP 2001-228754 A 8/2001
JP 2002-108596 A 4/2002
JP 2002108596 A * 4/2002
JP 3365988 B2 11/2002
JP 2003-252466 A 9/2003
JP 3601519 B2 10/2004
JP 2006027846 A * 2/2006
JP 2007-058544 A 3/2007
JP 2007-320297 A 12/2007

OTHER PUBLICATIONS

Machine Translation of JP 2002108596 A, JPO, Feb. 8, 2012.*
Japanese Office Action dated Apr. 19, 2010 for Japanese Application No. 2008-085583 and English-language translation.

* cited by examiner

*Primary Examiner* — Judy Nguyen
*Assistant Examiner* — Nguyen Q Ha
(74) *Attorney, Agent, or Firm* — Sughrue Mion, PLLC

(57) ABSTRACT

An image forming apparatus includes: a paper feeding device that supplies paper; a reception unit that receives a print instruction including output control information in which a paper type is designated by page; a setting unit that sets a priority in paper change by paper type based on the output control information included in the print instruction received by the reception unit; an instruction unit that issues a paper change instruction based on the priority set by the setting unit; and a printing device that performs printing on paper of a type designated by the instruction unit.

13 Claims, 21 Drawing Sheets

OUTPUT CONTROL INFORMATION

| PAGE NUMBER | PAPER SIZE | PAPER QUALITY | COLOR |
|---|---|---|---|
| 1 | LT | NORMAL PAPER | WHITE |
| 2 | B4 | NORMAL PAPER | WHITE |
| 3 | A4 | NORMAL PAPER | WHITE |
| 4 | A4 | NORMAL PAPER | WHITE |
| ⋮ | ⋮ | | |
| 22 | A4 | NORMAL PAPER | WHITE |
| 23 | LT | NORMAL PAPER | WHITE |
| 24 | B4 | NORMAL PAPER | WHITE |
| ⋮ | ⋮ | | |
| 39 | LT | NORMAL PAPER | WHITE |
| 40 | B4 | NORMAL PAPER | WHITE |

LT SIZE: 10 PAGES

B4 SIZE: 10 PAGES

A4 SIZE: 20 PAGES

FIG. 7

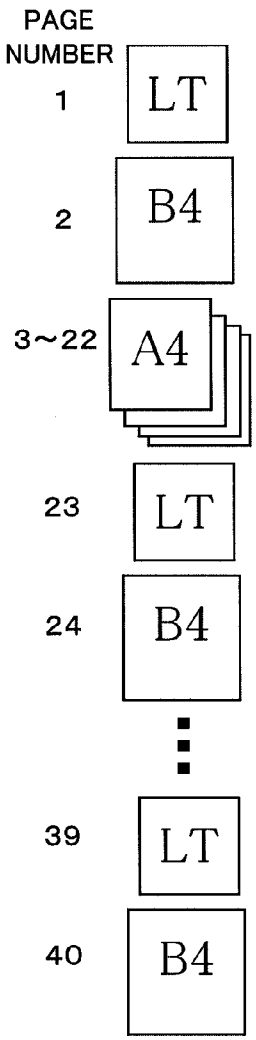

OUTPUT CONTROL INFORMATION

| PAGE NUMBER | PAPER SIZE | PAPER QUALITY | COLOR |
|---|---|---|---|
| 1 | LT | NORMAL PAPER | WHITE |
| 2 | B4 | NORMAL PAPER | WHITE |
| 3 | A4 | NORMAL PAPER | WHITE |
| 4 | A4 | NORMAL PAPER | WHITE |
| ⋮ | ⋮ | | |
| 22 | A4 | NORMAL PAPER | WHITE |
| 23 | LT | NORMAL PAPER | WHITE |
| 24 | B4 | NORMAL PAPER | WHITE |
| ⋮ | ⋮ | | |
| 39 | LT | NORMAL PAPER | WHITE |
| 40 | B4 | NORMAL PAPER | WHITE |

PRIORITY SETTING TABLE

| PRIORITY | PAPER SIZE | NUMBER OF PAGES | PAPER QUALITY | COLOR | FINAL PAGE |
|---|---|---|---|---|---|
| 1 | A4 | 20 | NORMAL PAPER | WHITE | 22 |
| 2 | LT | 10 | NORMAL PAPER | WHITE | 39 |
| 3 | B4 | 10 | NORMAL PAPER | WHITE | 40 |

LT SIZE: 500 PAGES

B4 SIZE: 500 PAGES

A4 SIZE: 600 PAGES

OUTPUT CONTROL INFORMATION

| PAGE NUMBER | PAPER SIZE | PAPER QUALITY | COLOR |
|---|---|---|---|
| 1 | LT | NORMAL PAPER | WHITE |
| 2 | B4 | NORMAL PAPER | WHITE |
| 3 | A4 | NORMAL PAPER | WHITE |
| 4 | A4 | NORMAL PAPER | WHITE |
| ⋮ | ⋮ | | |
| 602 | A4 | NORMAL PAPER | WHITE |
| 603 | LT | NORMAL PAPER | WHITE |
| 604 | B4 | NORMAL PAPER | WHITE |
| ⋮ | ⋮ | | |
| 1599 | LT | NORMAL PAPER | WHITE |
| 1600 | B4 | NORMAL PAPER | WHITE |

PRIORITY SETTING TABLE

| PRIORITY | PAPER SIZE | NUMBER OF PAGES | PAPER QUALITY | COLOR | FINAL PAGE |
|---|---|---|---|---|---|
| 1 | A4 | 600 | NORMAL PAPER | WHITE | 602 |
| 2 | LT | 500 | NORMAL PAPER | WHITE | 1599 |
| 3 | B4 | 500 | NORMAL PAPER | WHITE | 1600 |

PRIORITY SETTING TABLE

| PRIORITY | PAPER SIZE | NUMBER OF PAGES | PAPER QUALITY | COLOR | FINAL PAGE |
|---|---|---|---|---|---|
| 1 | LT | 500 | NORMAL PAPER | WHITE | 1599 |
| 2 | B4 | 500 | NORMAL PAPER | WHITE | 1600 |

FIG. 17

PAPER CHANGE INSTRUCTION DOCUMENT

200X.YY.ZZ

TRANSMISSION INFORMATION

USER NAME: USER 1

FILE NAME: Test1.prn

PAPER CHANGE PROCEDURE

| ORDER | TRAY | SIZE | PAPER QUALITY | NUMBER OF SHEETS |
|---|---|---|---|---|
| 1 | TRAY 1 | A4 | NORMAL PAPER | 20 |
| 2 | TRAY 2 | LT | NORMAL PAPER | 10 |
| 3 | MANUAL PAPER FEED | B4 | NORMAL PAPER | 1 |
| 4 | TRAY 1 | B4 | NORMAL PAPER | 9 |

FIG. 20A

| PRIORITY | PAPER COLOR |
|---|---|
| 1 | RED |
| 2 | WHITE |

FIG. 20B

| PRIORITY | PAPER QUALITY |
|---|---|
| 1 | RECYCLED PAPER |
| 2 | BACKING PAPER |
| 3 | NORMAL PAPER |
| 4 | CARDBOARD |

FIG. 21A

PRIORITY SETTING TABLE
(PRIORITY ON FREQUENCY OF APPEARANCE)

| PRIORITY | PAPER SIZE | FREQUENCY OF APPEARANCE | PAPER QUALITY | COLOR | FINAL PAGE |
|---|---|---|---|---|---|
| 1 | LT | 10 | NORMAL PAPER | WHITE | 39 |
| 2 | B4 | 10 | NORMAL PAPER | WHITE | 40 |
| 3 | A4 | 1 | NORMAL PAPER | WHITE | 22 |

FIG. 21B

PRIORITY SETTING TABLE
(PRIORITY ON PAPER COLOR)

| PRIORITY | PAPER SIZE | NUMBER OF PAGES | PAPER QUALITY | COLOR | FINAL PAGE |
|---|---|---|---|---|---|
| 1 | A3 | 50 | CARD-BOARD | RED | 500 |
| 2 | A4 | 600 | NORMAL PAPER | WHITE | 700 |
| 3 | LT | 500 | RECYCLED PAPER | WHITE | 1400 |
| 4 | B4 | 300 | BACKING PAPER | WHITE | 1450 |

FIG. 21C

PRIORITY SETTING TABLE
(PRIORITY ON PAPER QUALITY)

| PRIORITY | PAPER SIZE | NUMBER OF PAGES | PAPER QUALITY | COLOR | FINAL PAGE |
|---|---|---|---|---|---|
| 1 | LT | 500 | RECYCLED PAPER | WHITE | 1400 |
| 2 | B4 | 300 | BACKING PAPER | WHITE | 1450 |
| 3 | A4 | 600 | NORMAL PAPER | WHITE | 700 |
| 4 | A3 | 50 | CARD-BOARD | RED | 500 |

IMAGE FORMING APPARATUS, IMAGE FORMING SYSTEM, IMAGE FORMING METHOD AND COMPUTER READABLE MEDIUM STORING PROGRAM

CROSS-REFERENCE TO RELATED APPLICATIONS

This application is based on and claims priority under 35 USC 119 from Japanese Patent Application No. 2008-085583 filed Mar. 28, 2008.

BACKGROUND

Technical Field

The present invention relates to an image forming apparatus, an image forming system, an image forming method and a computer readable medium storing a program.

SUMMARY

According to an aspect of the present invention, there is provided an image forming apparatus including: a paper feeding device that supplies paper; a reception unit that receives a print instruction including output control information in which a paper type is designated by page; a setting unit that sets a priority in paper change by paper type based on the output control information included in the print instruction received by the reception unit; an instruction unit that issues a paper change instruction based on the priority set by the setting unit; and a printing device that performs printing on paper of a type designated by the instruction unit.

BRIEF DESCRIPTION OF THE DRAWINGS

Exemplary embodiments of the present invention will be described in detail based on the following figures, wherein:

FIG. 7 illustrates an example of a priority setting table generated from the output control information;

FIG. 17 illustrates an example of paper change instruction document;

FIG. 20A illustrates an example of a condition for setting of priority in correspondence with paper color;

FIG. 20B illustrates an example of a condition for setting of priority in correspondence with paper quality;

FIG. 21A illustrates an example of the priority setting table when priority is placed on the appearance frequency;

FIG. 21B illustrates an example of the priority setting table when priority is placed on the paper color; and FIG. 21C illustrates an example of the priority setting table when priority is placed on the paper quality.

DETAILED DESCRIPTION

[Background]

First, to assist understanding of the present invention, its background and outline will be described.

A print job (print instruction) to instruct execution of print processing includes a device control command (output control information) for tray selection, paper size designation, and designation of post processing such as execution/non-execution of stapling, as well as a drawing command to form an image. Generally, in the device control command, however, only the same contents are set for one print job. Accordingly, in this case, only one type of print paper is designated for the entire print job.

Unlike this conventional print job, a print job in which the device control command can be set by page is used. By using this print job, output control different by page of one print job can be performed. For example, print processing using A4 sized printing paper is executed for the first page, and then for the second and the subsequent pages, print processing using B4 sized printing paper can be executed. Further, print processing using cardboard printing paper is executed for the first page, and then for the second and the subsequent pages, print processing using normal printing paper can be executed.

In the exemplary embodiment of the present invention described below, an image forming system for execution of print processing using a print job in which such device control command can be set by page will be described.

Next, the exemplary embodiments of the present invention will be described in detail with reference to the drawings.

[First Exemplary Embodiment]

Figure 1:
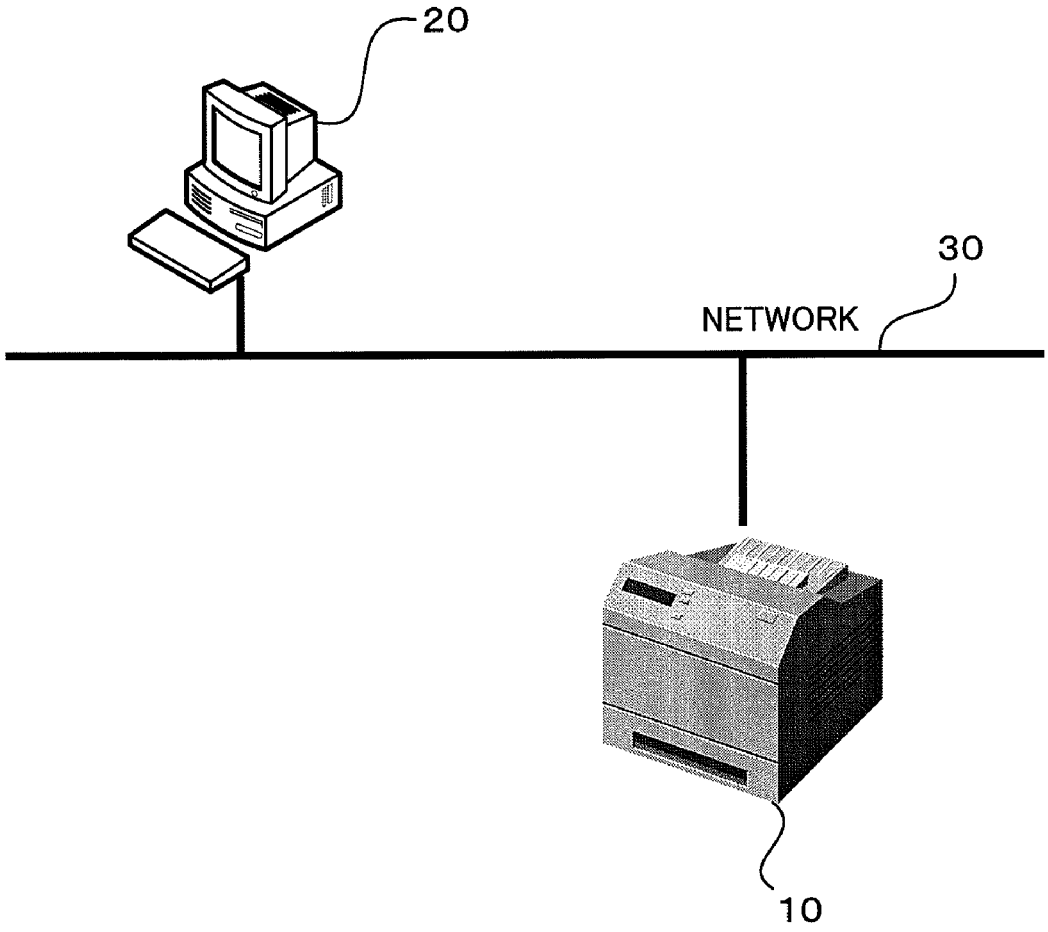
FIG. 1 is a block diagram showing the system configuration of an image forming system of a first exemplary embodiment of the present invention.

FIG. 1 is a block diagram showing the system configuration of an image forming system according to a first exemplary embodiment of the present invention.

As shown in FIG. 1, the image forming system of the present exemplary embodiment has an image forming apparatus 10 and a terminal device 20 interconnected via a network 30. The terminal device 20 functions as a print instruction device which generates print data and transmits the generated print data to the image forming apparatus 10 via the network 30. The terminal device 20 has a transmission unit to transmit a print job (print instruction) including a device control command (output control information) in which a paper type can be designated by page. The image forming apparatus 10 receives the print data transmitted from the terminal device 20 and outputs an image corresponding to the print data on paper. Note that the image forming apparatus 10 may be a printer having only a print function or may be a so-called multi-function machine having plural functions such as a print function, a scan function, a duplication (copy) function and a facsimile function.

Next, the hardware configuration of the image forming apparatus 10 in the image forming system of the present exemplary embodiment will be described with reference to FIG. 2.

Figure 2:
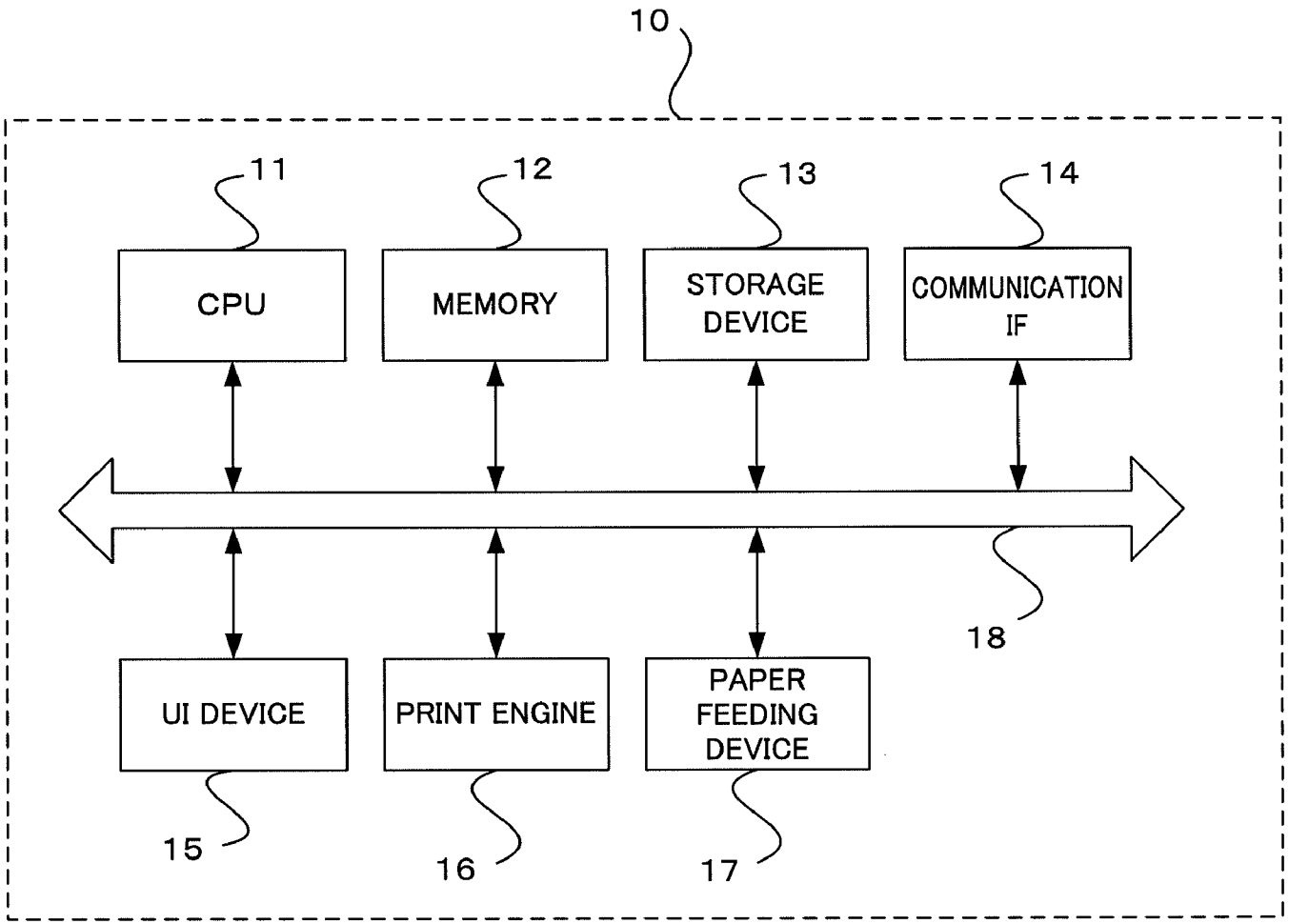
FIG. 2 is a block diagram showing the hardware configuration of an image forming apparatus 10 in the first exemplary embodiment of the present invention.

As shown in FIG. 2, the image forming apparatus 10 has a CPU 11, a memory 12, a storage device 13 such as a hard disk drive (HDD), a communication interface (I/F) 14 for data transmission and reception with an external device or the like via the network 30, a user interface (UI) 15 including a touch panel or a liquid crystal display and a keyboard, a print engine (printing device) 16, and a paper feeding device 17. These constituent elements are interconnected via a control bus 18. The print engine 16 performs printing on paper supplied from the paper feeding device 17.

The CPU 11 performs predetermined processing based on a control program stored in the memory 12 or the storage device 13, to control the operation of the image forming apparatus 10.

Note that in the present exemplary embodiment, the CPU 11 reads the control program stored in the memory 12 or the storage device 13 and executes it, however, it may be arranged such that the control program is stored on a storage medium such as a CD-ROM and supplied to the CPU 11.

Figure 3:
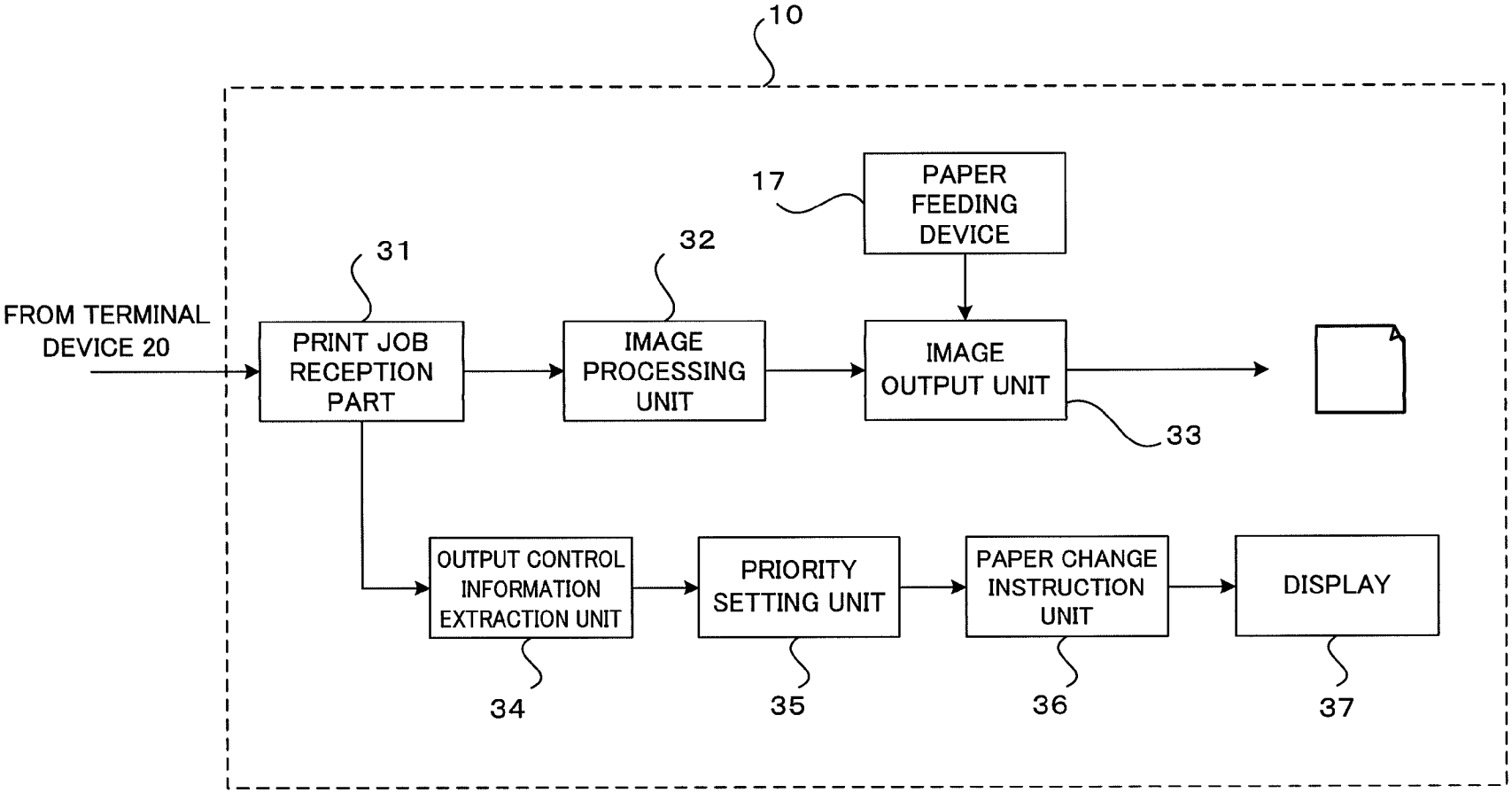
FIG. 3 is a block diagram showing the functional configuration of the image forming apparatus 10 in the first exemplary embodiment of the present invention.

FIG. 3 is a block diagram showing the functional configuration of the image forming apparatus 10 realized by execution of the above-described control program.

As shown in FIG. 3, the image forming apparatus 10 of the present exemplary embodiment has a print job reception part 31, an image processing part 32, an image output part 33, the paper feeding device 17, an output control information extraction part 34, a priority setting part 35, a paper change instruction part 36, and a display 37.

The print job reception part 31 receives a print job from the terminal device 20. The image processing part 32 generates print data by performing various image processing on the print job received by the print job reception part 31. The paper feeding device 17 supplies printing paper in a designated paper size to the image output part 33. The image output part 33 outputs an image on the printing paper supplied from the paper feeding device 17, based on the print data generated by the image processing part 32.

Figure 4:
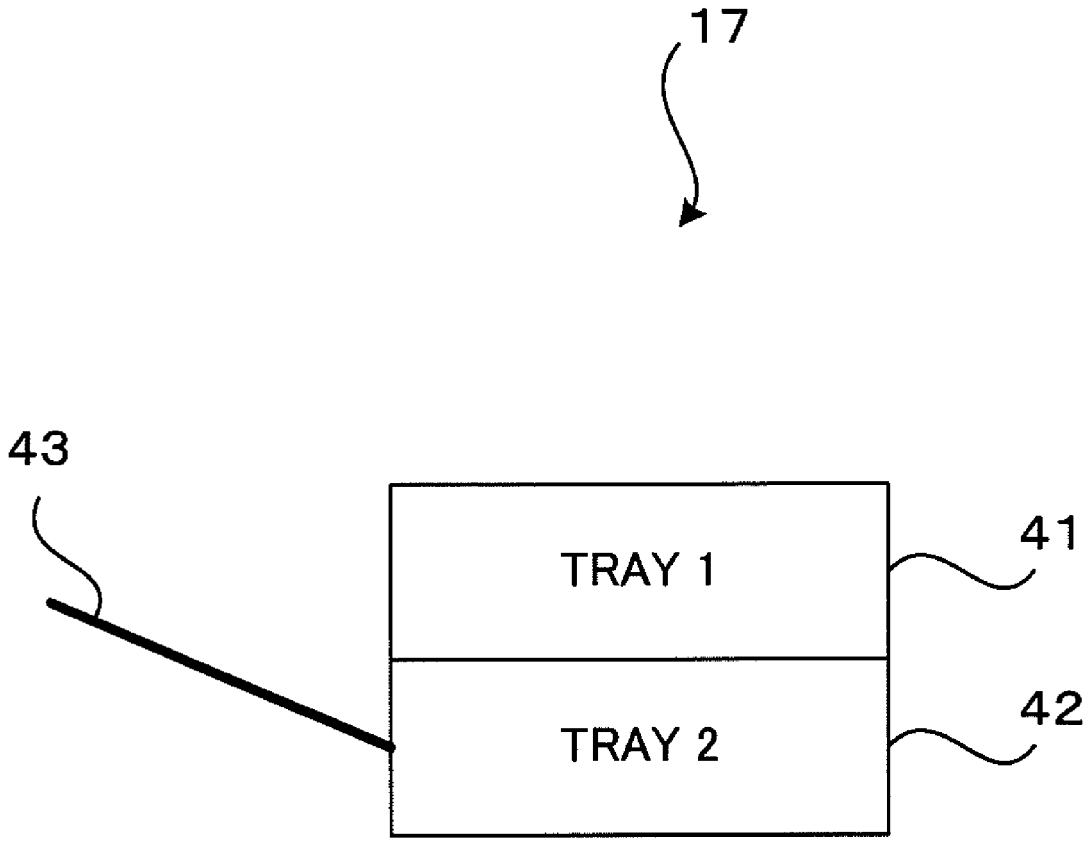
FIG. 4 is a schematic cross-sectional view explaining the structure of a paper feeding device 17.

In the image forming apparatus 10 of the present exemplary embodiment, as shown in FIG. 4, the paper feeding device 17 has a paper feed tray 41 (hereinbelow, referred to as a "tray 1"), a paper feed tray 42 (hereinbelow, referred to as a "tray 2") and a manual paper feed tray 43. For the tray 1, the tray 2 and the manual paper feed tray 43, a print instruction with designation of one paper size can be set.

Further, the output control information extraction part 34 extracts output control information from the print job received by the print job reception part 31.

The priority setting part 35 sets priorities in paper change by paper type such as paper size, paper quality and color, based on the output control information extracted by the output control information extraction part 34. In this exemplary embodiment, the priority setting part 35 sets priorities according to the number of pages by paper type. That is, the priority setting part 35 sets priorities such that a paper type having a larger number of pages has a higher priority.

Further, the priority setting part 35 sets final page information by each paper type, based on the output control information extracted by the output control information extraction part 34. The final page information is information indicating a final page in printing on paper by paper type in the print job.

When paper of a designated paper type is not set in the paper feeding device 17 in execution of print processing, the paper change instruction part 36 issues a paper change instruction based on the priority set by the priority setting part 35. More particularly, when paper of a designated paper type is not set in the paper feeding device 17, the paper change instruction part 36 instructs to change paper of a paper type other than a paper type with a higher priority than that of the designated paper type, for the paper of the designated paper type.

Note that the paper change instruction includes an instruction to set paper on a tray holding no paper as well as an instruction to change already-set paper with paper of another type.

The display 37 displays the paper change instruction issued by the paper change instruction part 36 in a visible form for a user.

Next, the operation of the image forming system in the present exemplary embodiment will be described in detail with reference to the drawings.

Figure 5:
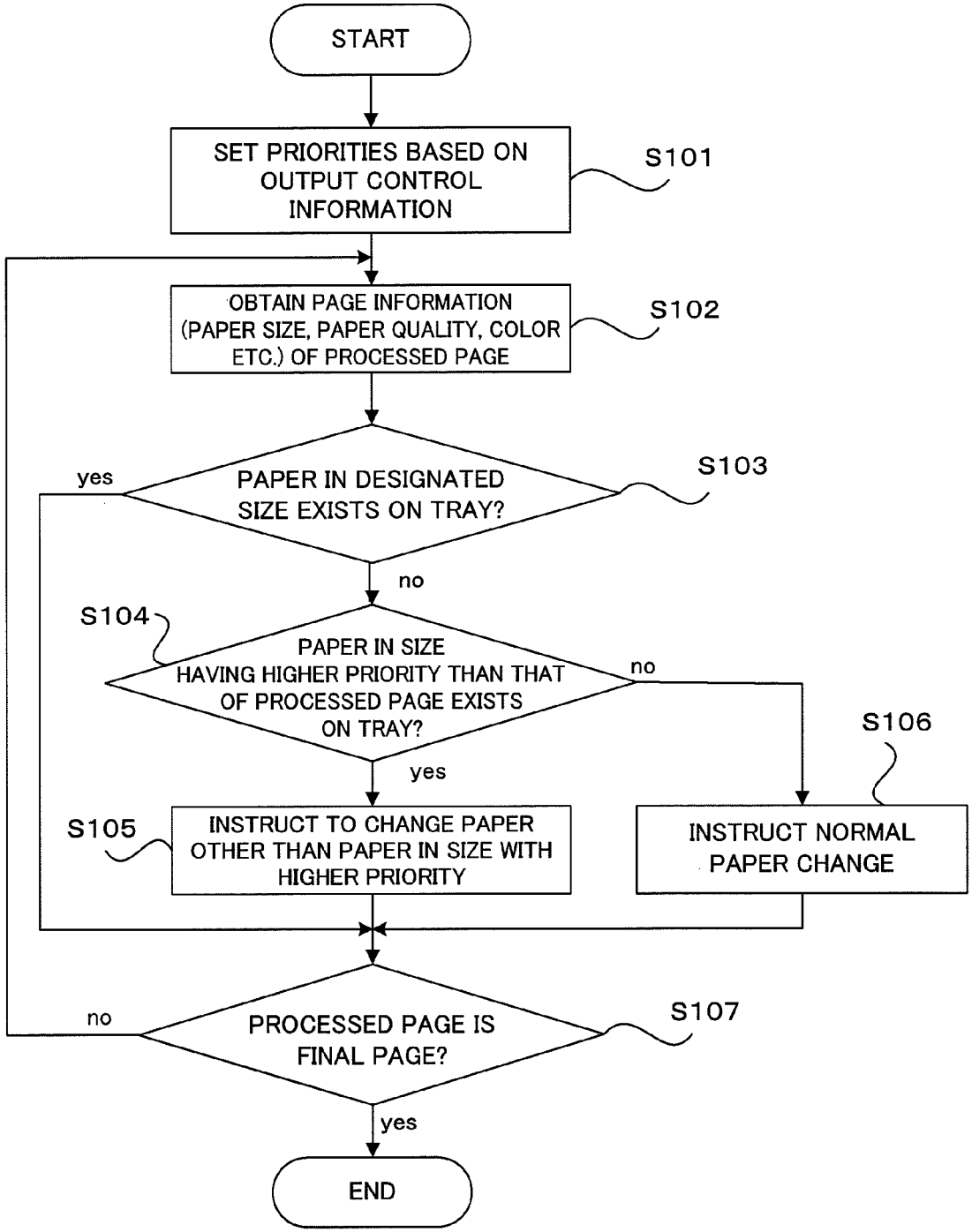
FIG. 5 is a flowchart showing the operation of the image forming apparatus 10 of the first exemplary embodiment of the present invention.

FIG. 5 is a flowchart showing the operation of the image forming apparatus 10 in the present exemplary embodiment of the present invention.

Figure 6:
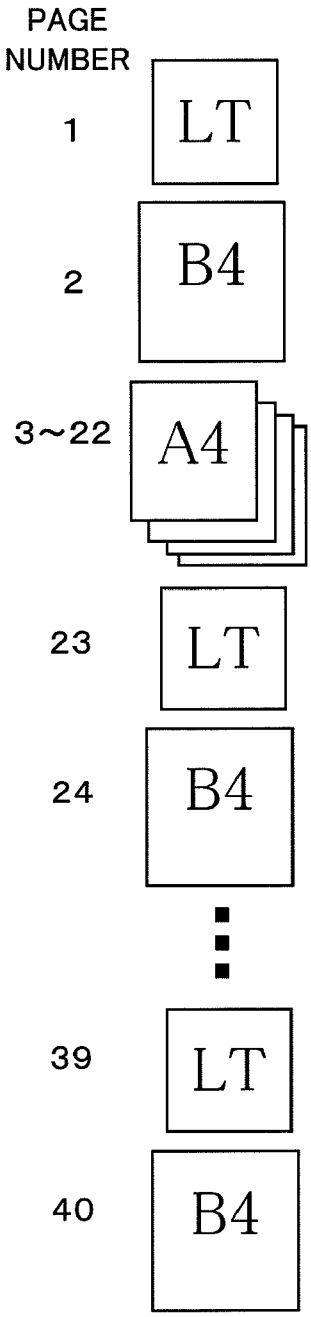
FIG. 6 illustrates an example of a print job having output control information.

In the following description, execution of print processing based on a print job as shown in FIG. 6 will be described.

As shown in FIG. 6, the print job has total 40-page print data with designated paper sizes, letter size (Hereinbelow abbreviated to "LT"), B4 size and A4 size. The letter size is an 8.5 inch×11 inch paper size. Note that even when the paper size is the same, if colors or the like are different, designation is treated as different paper types. In the present example, unless particularly explained, the paper quality and the paper color are the same for the sake of simplification of explanation.

In this print job, for the first page, LT size is designated as a paper size; for the second page, B4 size is designated as a paper size; for the third to twenty-second pages, A4 size is designated as a paper size; and for the twenty-third to fortieth pages, LT size and B4 size are alternately designated as paper sizes.

This print job includes output control information as shown in FIG. 6. The output control information includes information such as paper sizes, paper qualities and colors for the respective pages.

When such print job is transmitted from the terminal device 20 to the image forming apparatus 10, the print job reception part 31 of the image forming apparatus 10 receives the print job. Then the output control information extraction part 34 extracts output control information from the received print job. Then the priority setting part 35 sets a priority by paper type based on the extracted output control information (step S101). For example, as shown in FIG. 7, the priority setting part 35 generates a priority setting table from the output control information.

In the priority setting table shown in FIG. 7, priorities are set for paper types each having paper size, paper quality and color. For example, the first priority is set for a paper type with a paper size of A4, a paper quality of normal paper and a paper color of white. The second priority is set for a paper type with a paper size of LT, a paper quality of normal paper and a paper color of white. Further, the third priority is set for a paper type with a paper size of B4, a paper quality of normal paper and a paper color of white. In this example, a paper type with a larger number of pages has a higher priority.

Further, the priority setting table includes final page information on finally-designated pages of respective paper types in the print job, as well as the priorities for respective paper types. For example, in the print job as shown in FIG. 7, as A4 size is designated for the third to twenty-second pages, the final page of the paper type with A4 paper size is the twenty-second page. Similarly, the final page of the paper type with LT paper size is the thirty-ninth page; and the final page of the paper type with B4 paper size is the fortieth page.

Next, in the paper change instruction part 36, page information on a processed page such as paper size, paper quality, paper color and the like is obtained (step S102), and it is determined whether or not paper in the designated paper size exists on any tray of the paper feeding device 17 (step S103). When paper in the designated paper size exists on a tray, a paper change instruction is not issued but processing to set the next page as a processed page is performed. When paper in the designated paper size does not exist on any tray, it is determined whether or not paper in a paper size with a higher priority than that of the processed page exists on any tray (step S104).

When it is determined at step S104 that paper in a paper size with higher priority than that of the processed page exists on a tray, the paper change instruction part 36 issues a paper change instruction to change paper in a paper size other than that of the higher-priority paper for paper in the designated paper size for the processed page (step S105).

When it is determined at step S104 that paper in a paper size with a higher priority than that of the processed page does not exist on any tray, the paper change instruction part 36 issues a normal paper change instruction to change paper set on a predetermined tray for the paper in the paper size designated for the processed page (step S106).

Then, when the instructed paper change has been performed and print processing is executed by the image output part 33, it is determined whether or not the processed page is a final page (step S107). When it is determined that the processed page is not the final page, the next page is set as a processed page, and the process returns to step S102.

Figure 8:
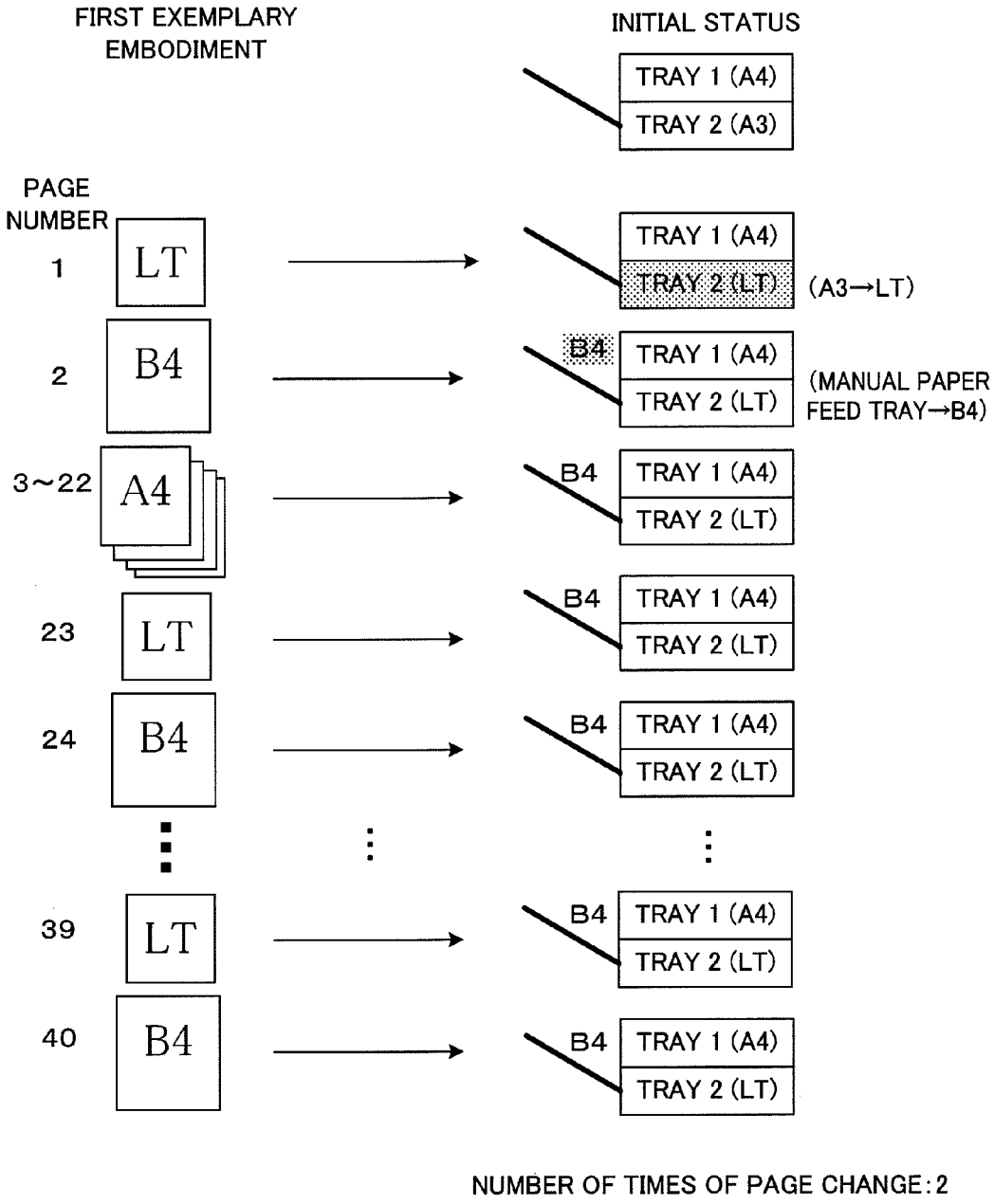
FIG. 8 illustrates paper change which occurs upon execution of a print job as shown in FIG. 7 by the image forming apparatus 10 of the first exemplary embodiment of the present invention.

When the print job as shown in FIG. 7 is executed by the image forming apparatus 10 having the paper feeding device 17 as shown in FIG. 4 by executing this processing by page, paper change as shown in FIG. 8 occurs.

As an initial status of the paper feeding device 17, no paper is set on the manual paper feed tray, A4 sized paper is set on the tray 1, and A3 sized paper is set on the tray 2.

When print job execution is started in this status, first, paper in LT size designated as a paper size for the first page is not set in any tray. Accordingly, the paper change instruction part 36 refers to the priority setting table thereby to check the priority of LT size. As A4 size of the paper already set on the tray 1 has a higher priority than that of LT size, the paper change instruction part 36 issues an instruction to change the A3 sized paper on the tray 2 with LT sized paper.

Then, when print processing for the LT sized first page has been executed and printing for the second page is executed, paper in B4 size designated as a paper size for the second page is not set on any tray. Accordingly, the paper change instruction part 36 refers to the priority setting table thereby to check the priority of B4 size. As A4 and LT sizes of the paper already set on the trays have higher priorities than the priority of B4 size, the paper change instruction part 36 issues an instruction to set B4 sized paper on the manual paper feed tray on which no paper has been set.

Thereafter, as all A4 sized, LT sized and B4 sized paper are set on the trays, the print job is executed to the end without issuance of paper change instruction.

In the example as shown in FIG. 8, the number of times of paper change necessary for execution of the print job to the end is 2.

Figure 9:
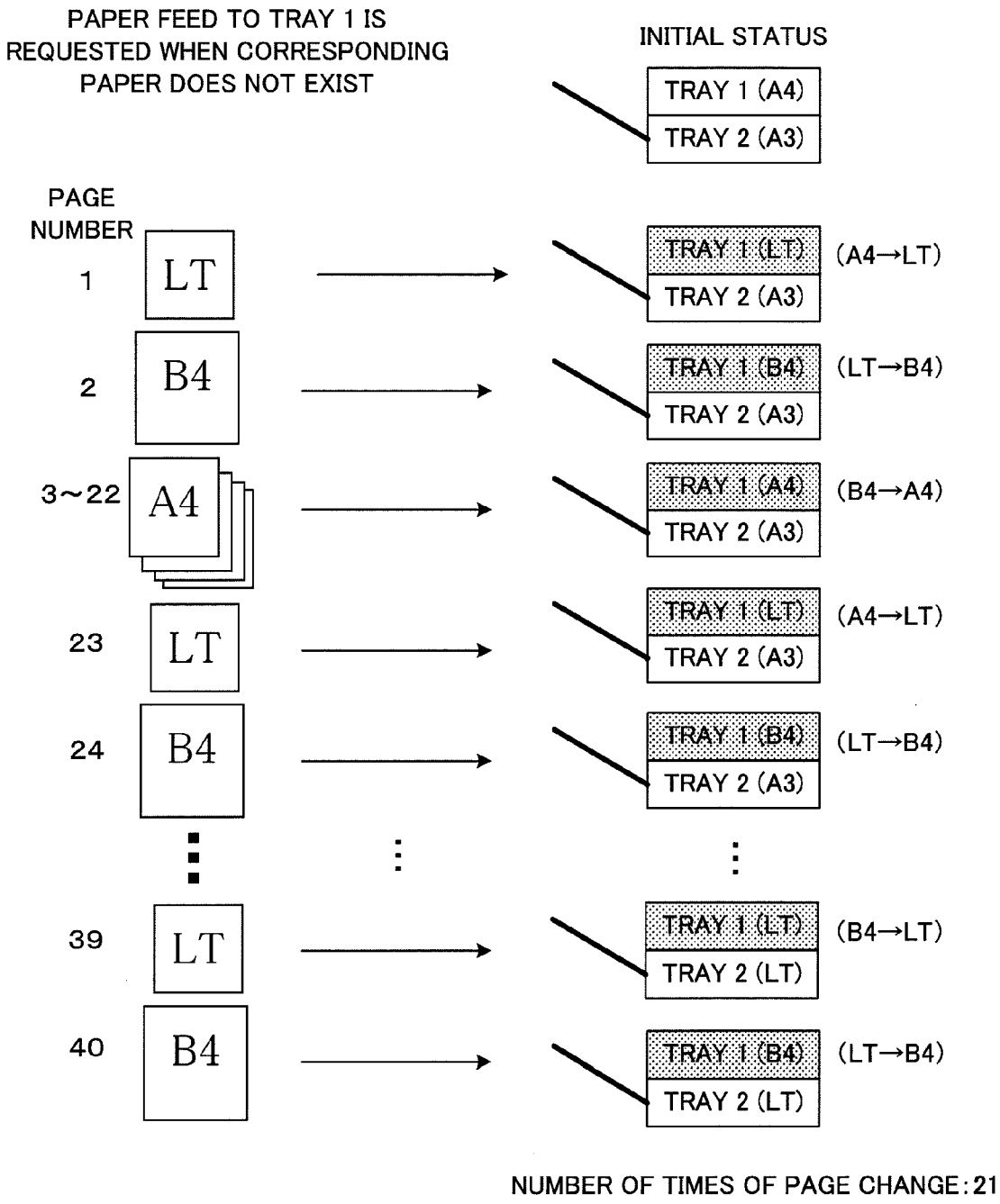
FIG. 9 (RELATED ART)
FIG. 9 illustrates paper change which occurs upon execution of the print job as shown in FIG. 7 by a paper change control method without use of the present invention.
Figure 10:
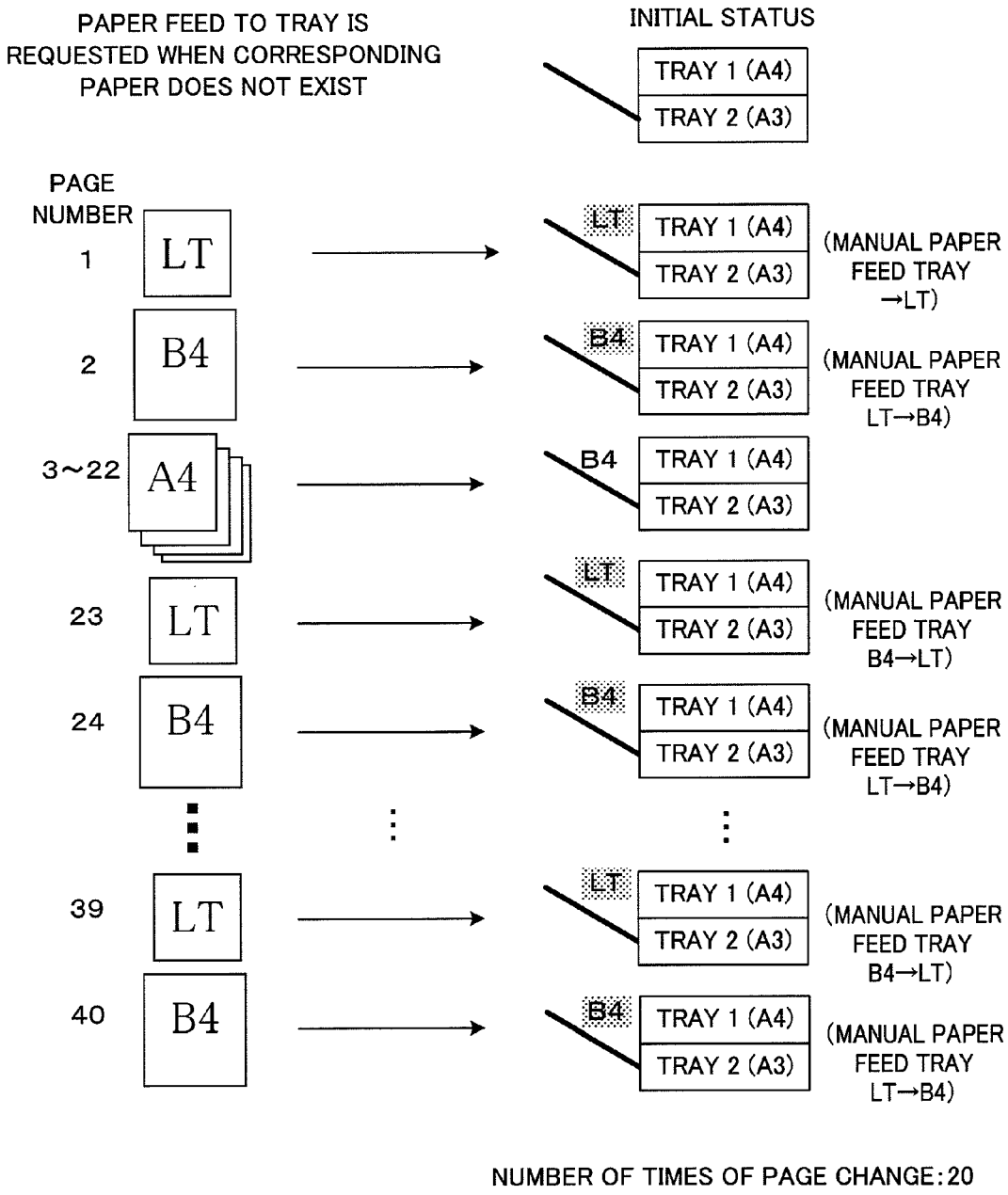
FIG. 10 RELATED ART
FIG. 10 illustrates paper change which occurs upon execution of the print job as shown in FIG. 7 by another paper change control method without use of the present invention.

FIGS. 9 and 10 illustrate paper change without use of the paper change control method by the image forming apparatus 10 of the present exemplary embodiment.

FIG. 9 illustrates a status using a paper change control method of, when appropriate paper is not set on any tray, changing paper on the tray 1. In FIG. 9, the initial status of the paper feeding device and the executed print job are the same as those described in FIG. 8.

First, when print processing for the first page is executed, as LT sized paper is not set on any tray, a paper change instruction to change the A4 sized paper on the tray 1 with LT size paper is issued.

Then, when print processing for the second page is executed, as B4 sized paper is not set on any tray, a paper change instruction to change the LT size paper on the tray 1 with B4 sized paper is issued.

Further, print processing for the third to twenty-second pages is executed, as A4 sized paper is not set on any tray, a paper change instruction to change the B4 sized paper on the tray 1 with A4 sized paper is issued.

In this manner, until printing for the fortieth page is completed, paper change instructions are issued to change the paper on the tray 1 in accordance with change of paper size. The number of times of paper change necessary for execution of the print job to the end is 21.

FIG. 10 illustrates a status using a paper change control method of, when appropriate paper is not set on any tray, requesting paper change on the manual paper feed tray. In FIG. 10, the initial status of the paper feeding device and the executed print job are the same as those described in FIG. 8.

First, when print processing for the first page is executed, as LT sized paper is not set on any tray, a paper change instruction to set LT sized paper on the manual paper feed tray is issued.

Then, when print processing for the second page is executed, as B4 sized paper is not set on any tray, a paper change instruction to change the LT sized paper on the manual paper feed tray for B4 sized paper is issued.

Further, when print processing for the third to twenty-second pages is executed, as the A4 sized paper is set on the tray 1, a paper change instruction is not issued.

Further, when print processing for the twenty-third page is performed, as LT sized paper is not set on any tray, a paper change instruction to change the B4 sized paper on the manual paper feed tray for LT sized paper is issued.

In this manner, for the twenty-fourth and the subsequent pages, until printing for the fortieth page is completed, paper change instructions to change the paper on the manual paper feed tray for LT sized paper and B4 sized paper upon change of paper size are issued. The number of times of paper change necessary for execution of the print job to the end is 20.

[Second Exemplary Embodiment]

Next, an image forming system according to a second exemplary embodiment of the present invention will be described.

In the image forming system of the present exemplary embodiment, the paper change instruction part 36 issues a paper change instruction, with paper of a paper type with which print processing for a final page has been completed as paper to be changed, using final page information set by the priority setting part 35.

Figure 11:
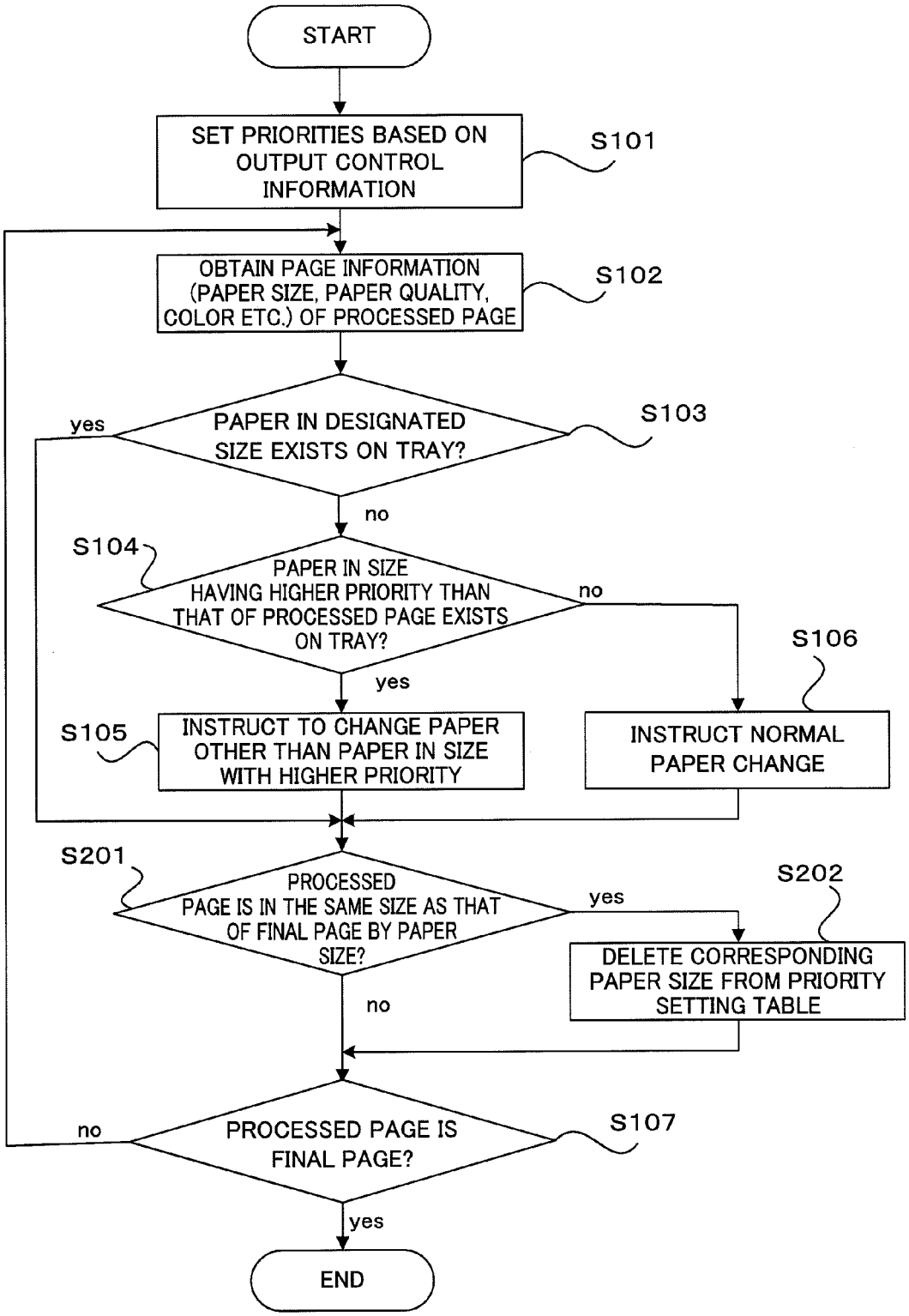
FIG. 11 is a flowchart showing the operation of the image forming apparatus 10 of a second exemplary embodiment of the present invention.

The operation of the image forming apparatus 10 of the present exemplary embodiment will be described with reference to the flowchart of FIG. 11. In the flowchart shown in FIG. 11, processing at steps S201 and S202 is added to the flowchart showing the operation of the first exemplary embodiment shown in FIG. 5.

At step S201, it is determined whether or not the processed page is the same as the final page set by paper size. When it is determined that the processed page is the same as the final page, the corresponding paper size is deleted from the priority table (step S202).

Figure 12:
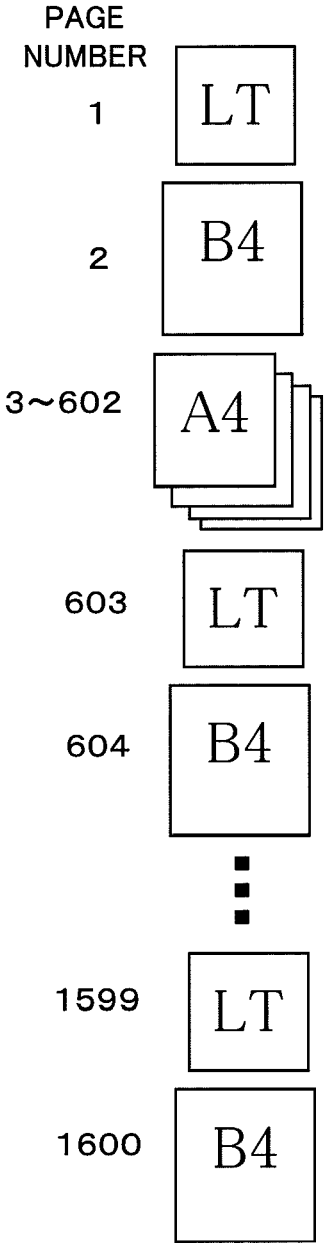
FIG. 12 illustrates another example of a print job having output control information.
Figure 13:
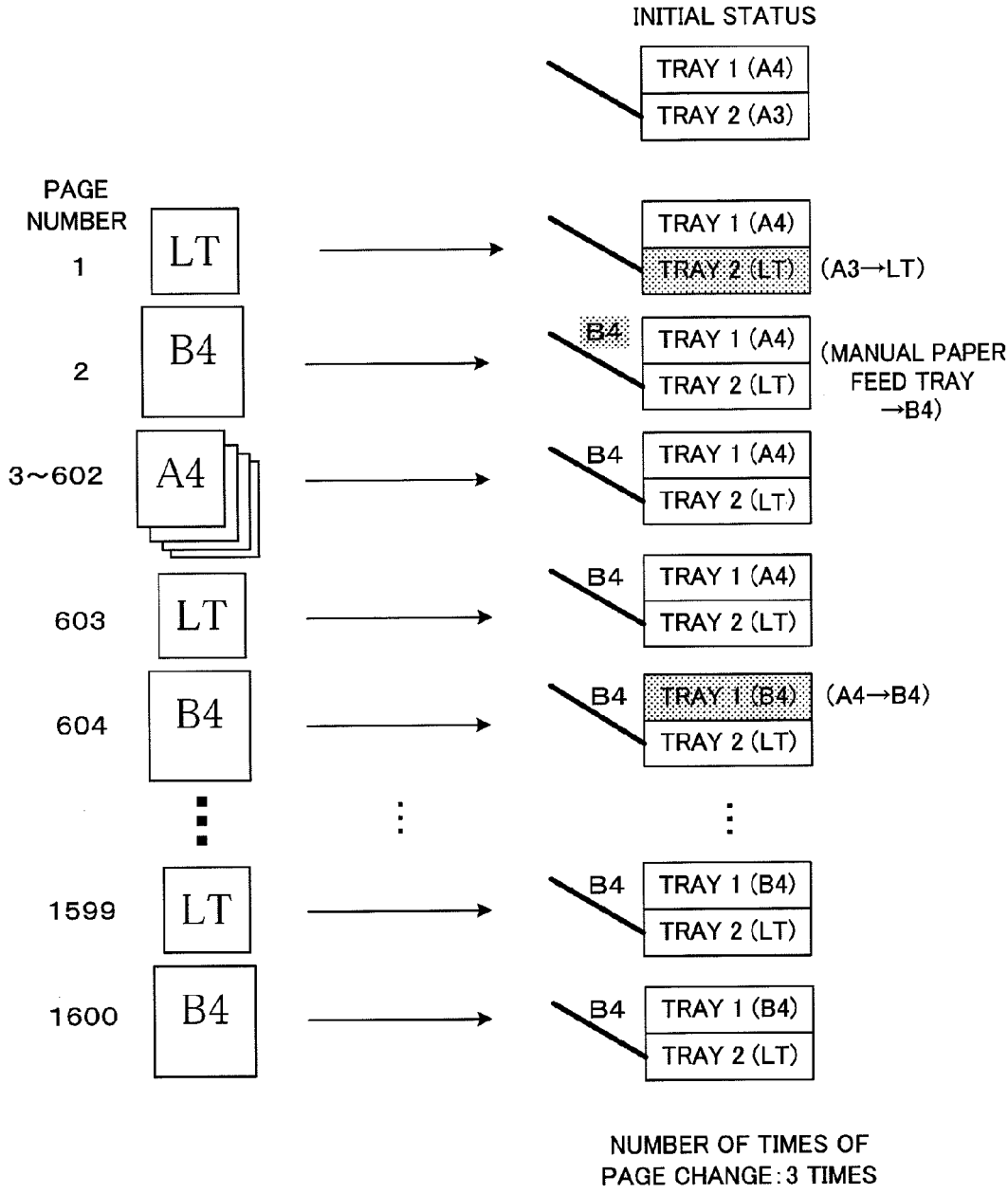
FIG. 13 illustrates paper change which occurs upon execution of the print job as shown in FIG. 12 by the image forming apparatus 10 of the second exemplary embodiment of the present invention.

This processing is performed by page, thereby, upon execution of the print job as shown in FIG. 12 by the image forming apparatus 10 having the paper feeding device 17 as shown in FIG. 4, paper change as shown in FIG. 13 occurs.

As an initial status of the paper feeding device 17, paper is not set on the manual paper feed tray, A4 sized paper is set on the tray 1, and A3 sized paper is set on the tray 2.

When print job execution is started in this status, first, paper in LT size designated as a paper size for the first page is not set in any tray. Accordingly, the paper change instruction part 36 refers to the priority setting table thereby to check the priority of LT size. As the A4 sized paper already set on the tray has a higher priority than that of LT size, the paper change instruction part 36 issues an instruction to change the A3 sized paper on the tray 2 with LT sized paper.

Then, when print processing for the LT sized first page has been executed and printing for the second page is executed, paper in B4 size designated as a paper size for the second page is not set on any tray. Accordingly, the paper change instruction part 36 refers to the priority setting table thereby to check the priority of B4 size. As A4 and LT sizes of the paper already set on the trays have higher priorities than the priority of B4 size, the paper change instruction part 36 issues an instruction to set B4 sized paper on the manual paper feed tray on which no paper has been set.

Figures 14A, 14B:
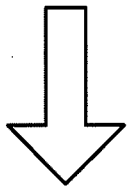
FIGS. 14A and 14B illustrate an example of deletion of paper size, in which print processing for a final page has been completed, from the priority setting table generated from the output control information.

The paper size designated for the third to six-hundred second page is A4. As A4 sized paper is already set on the tray 1, print processing is executed without issuance of a paper change instruction. Then, as the final page set for A4 size is the six-hundred second page as shown in FIG. 14A, when print processing for the six-hundred second page is executed, the A4 size information is deleted from the priority setting table as shown in FIG. 14B. In the priority setting table shown in FIG. 14B, the A4 size information is deleted, and the priorities of LT size and B4 size are respectively moved up by 1, from the priority setting table shown in FIG. 14A.

In this manner, as the priority of A4 size is deleted, thereby the A4 sized paper can be changed with B4 or LT sized paper. For example, when the upper limit of number of sheets loadable on the manual paper feed tray is 100, upon execution of printing for B4 sized 500 pages, paper setting occurs five times. Accordingly, to reduce the number of times of paper change, a paper change instruction is issued to change the A4 sized paper, the priority of which has been deleted and which is set on the tray 1, for B4 sized paper.

In the example shown in FIG. 13, an instruction to change the A4 sized paper on the tray 2 with B4 sized paper is issued in the processing for the six-hundred fourth page. Thereafter, as both LT sized paper and B4 sized paper are set on the tray 1 and the tray 2, the print job is executed to the end without issuance of paper change instruction.

In the example shown in FIG. 13, the number of times of paper change necessary for execution of the print job to the end is 3.

[Third Exemplary Embodiment]

Next, the image forming system according to a third exemplary embodiment of the present invention will be described.

In the image forming system of the present exemplary embodiment, when paper of designated paper type is not set and the number of paper types designated in a print job is larger than the number of paper types settable in the paper feeding device 17, and further, when paper of paper type with a lower priority than that of the designated paper type is set in the paper feeding device 17, the paper change instruction part 36 issues an instruction to feed paper of the designated paper type to the manual paper feed tray as a particular paper feed tray.

Figure 15:
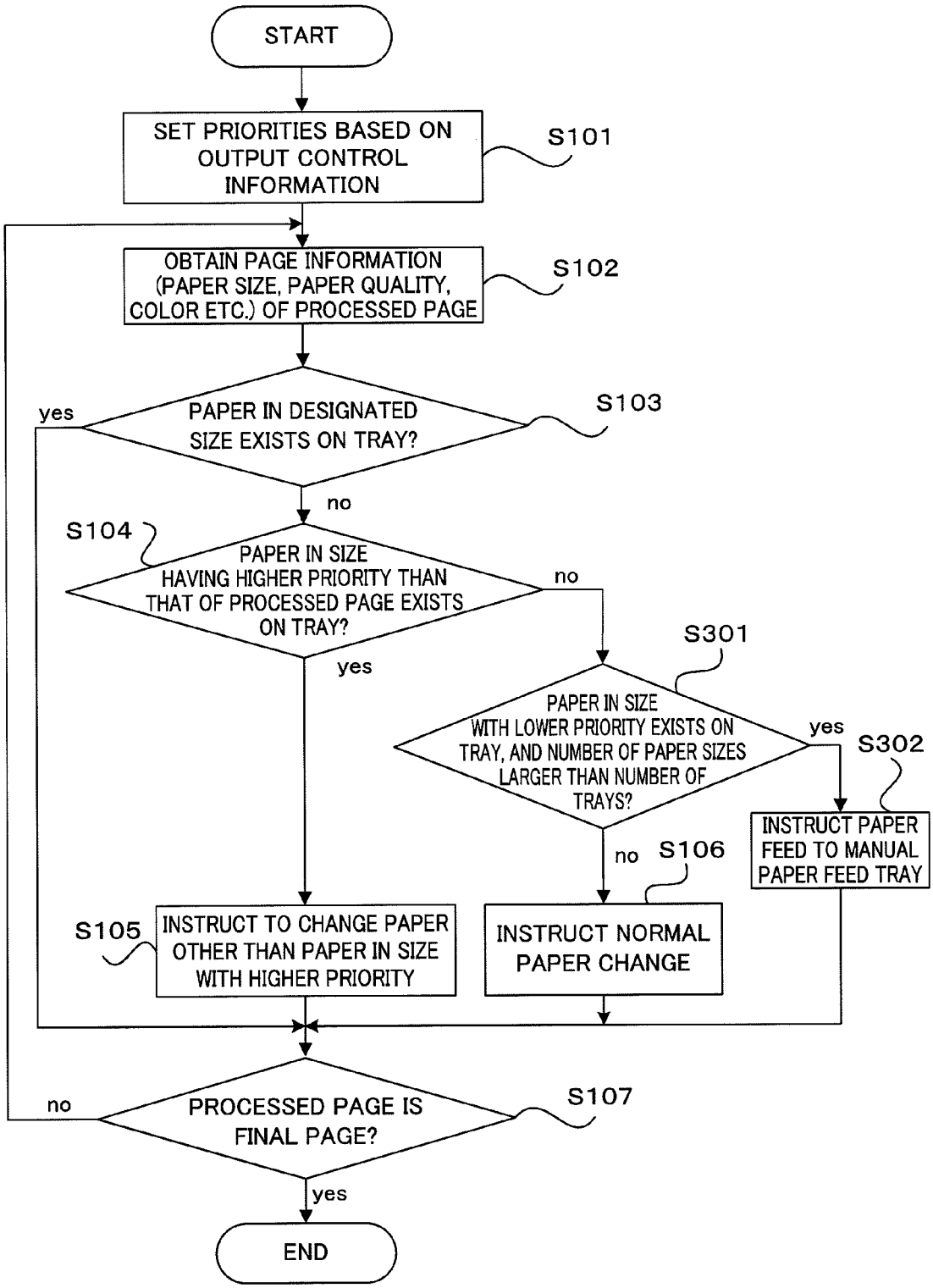
FIG. 15 is a flowchart showing the operation of the image forming apparatus 10 of a third exemplary embodiment of the present invention.

The operation of the image forming apparatus 10 of the present exemplary embodiment will be described with reference to the flowchart of FIG. 15. In the flowchart shown in FIG. 15, processing at steps S301 and S302 is added to the flowchart showing the operation of the first exemplary embodiment shown in FIG. 5.

When it is determined at step S104 that paper in a paper size with a higher priority than that of the processed page does not exist on any tray, it is determined whether or not paper in paper size with a lower priority exists on a tray and whether or not the number of paper sizes is larger than the number of trays (step S301) Then at step S301, when it is determined that paper in a paper size with a lower priority exists on a tray and the number of paper sizes is larger than the number of trays, an instruction to feed paper in the designated paper size to the manual paper feed tray is issued (step S302).

[Fourth Exemplary Embodiment]

Next, the image forming system of a fourth exemplary embodiment of the present invention will be described.

In the image forming system of the present exemplary embodiment, a generation unit (not shown) to generate a paper change procedure based on priorities set by the priority setting part 35 is provided in the image forming apparatus 10, and the image output part 33 prints an instruction document indicating the paper change procedure generated by the generation unit.

Figure 16:
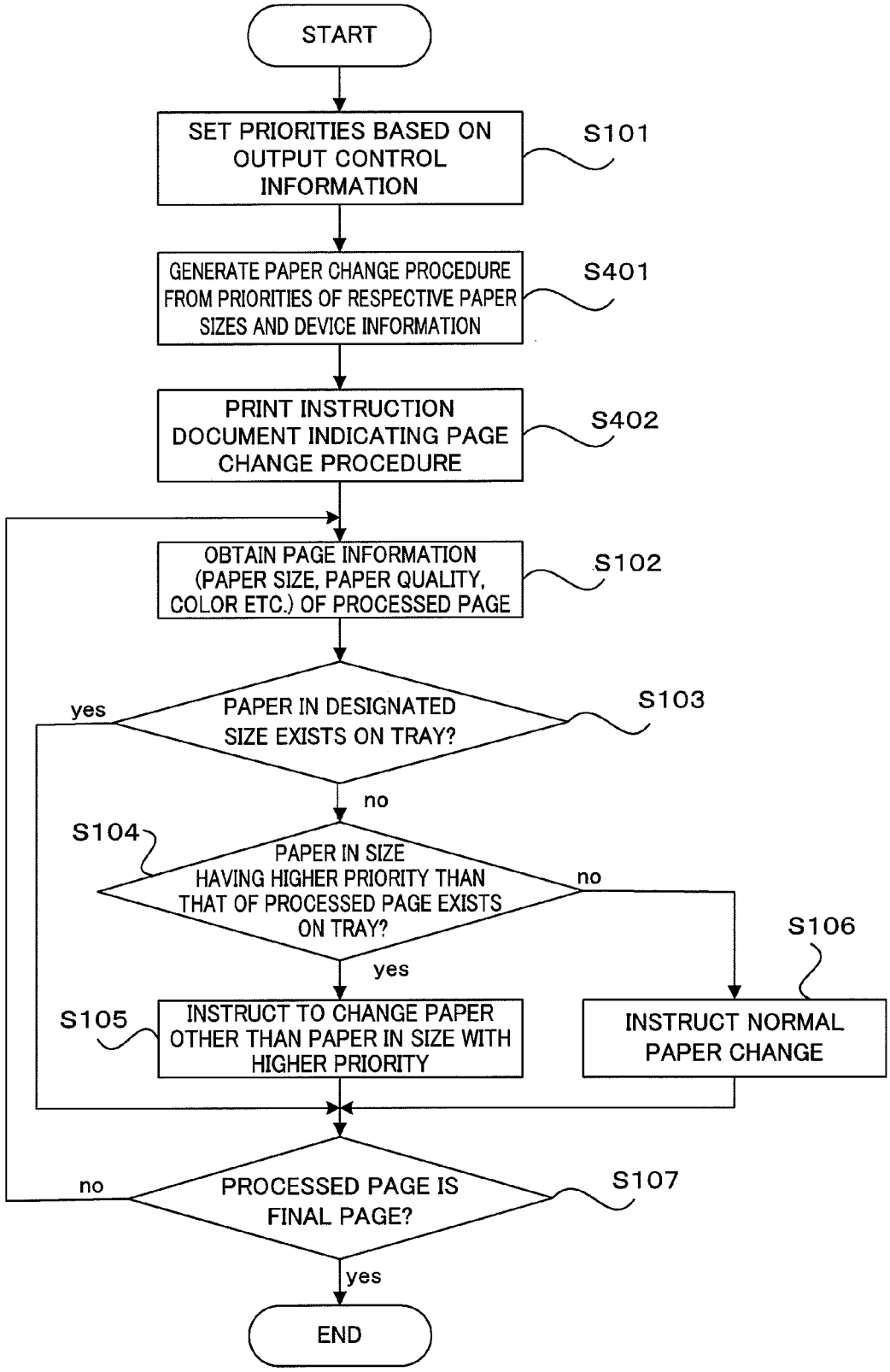
FIG. 16 is a flowchart showing the operation of the image forming apparatus 10 of a fourth exemplary embodiment of the present invention.

The operation of the image forming apparatus 10 of the present exemplary embodiment will be described with reference to the flowchart of FIG. 16. In the flowchart shown in FIG. 16, processing at steps S401 and S402 is added to the flowchart showing the operation of the first exemplary embodiment shown in FIG. 5.

When the print job reception part 31 receives a print job from the terminal device 20 and the priority setting part 35 sets priorities (step S101), a paper change procedure necessary for execution of the print job to the end is generated (step S401) based on device information indicating priorities of respective paper sizes, the trays provided in the paper feeding device 17, paper sizes of paper set on the trays, and the like. Then before the start of print processing, the image output part 33 prints an instruction document to indicate the generated paper change procedure (step S402).

FIG. 17 shows an example of the paper change instruction document printed as above. As shown in FIG. 17, the paper change instruction document indicates information on necessary paper types for the respective trays upon paper change.

Figure 18:
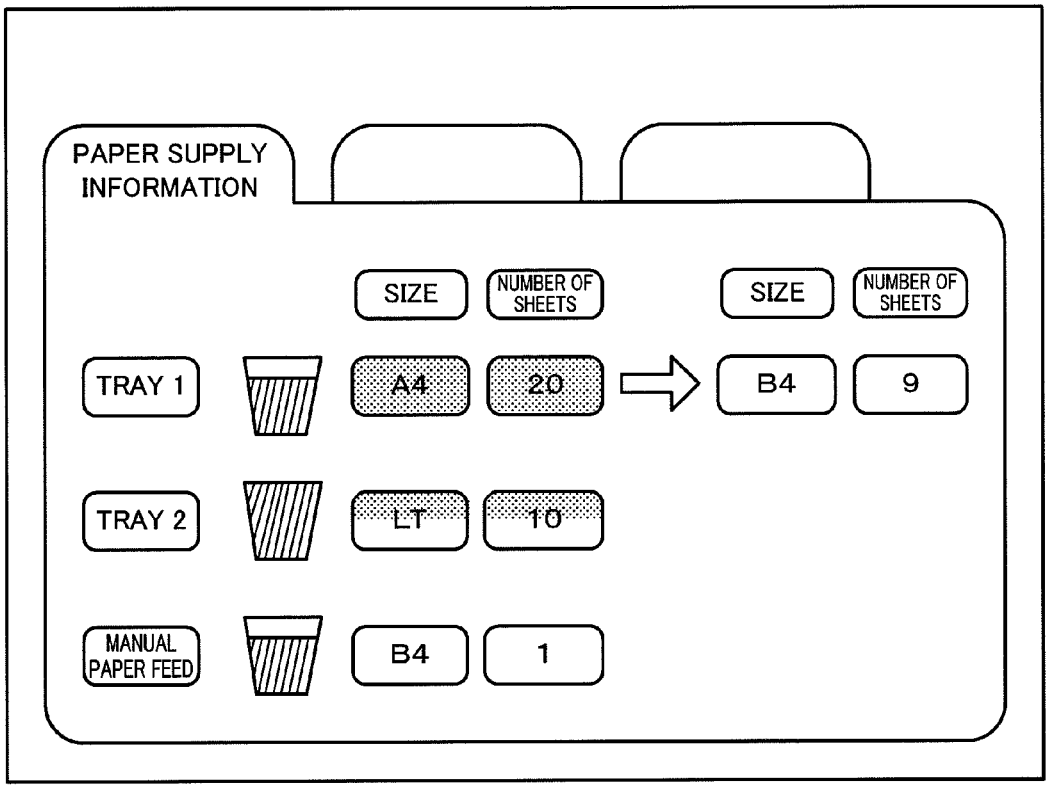
FIG. 18 illustrates an example of paper supply information.

Note that it may be arranged such that in issuance of paper change instruction, paper supply information indicating current statuses of the respective trays in the paper feeding device 17 and necessary paper change processing in the future, is presented to a user. FIG. 18 shows an example of such paper supply information. In the paper supply information shown in FIG. 18, as the color of display corresponding to paper on which print processing has been completed is changed, the completion of print processing on the paper in the paper size is understood, and information on the next necessary paper size can be informed. Further, the paper supply information may be displayed on the display 37 of the image forming apparatus 10, or may be displayed on a display screen of the terminal device 20.

[Fifth Exemplary Embodiment]

Next, the image forming system of a fifth exemplary embodiment of the present invention will be described.

In the above-described first to fourth exemplary embodiments, priorities are set in correspondence with the number of pages by paper type. However, the priorities may be set based on other information than the number of pages.

Figure 19:
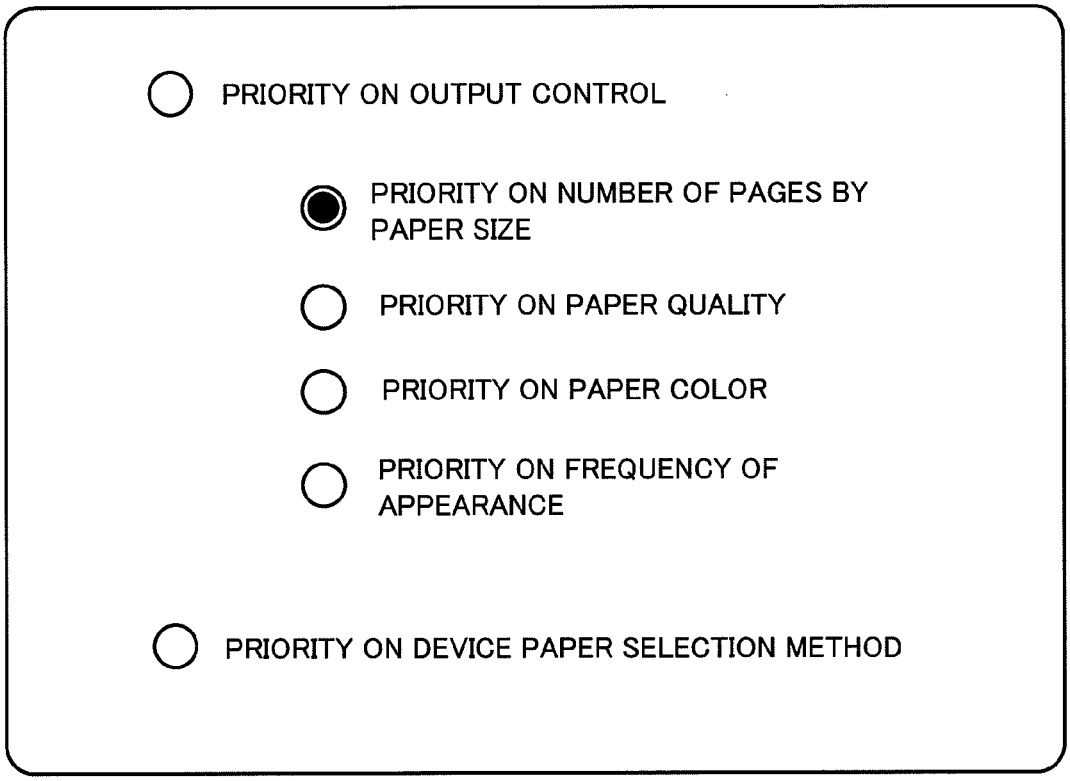
FIG. 19 illustrates an example of display screen when setting of priority in correspondence with the number of pages, setting of priority in correspondence with paper quality, setting of priority in correspondence with paper color, or setting of priority in correspondence with frequency of appearance is selected based on a user's selection.

For example, it may be arranged such that a screen as shown in FIG. 19 is displayed on the display 37, and the priority setting in correspondence with the number of pages, the priority setting in correspondence with paper quality, the priority setting in correspondence with paper color, or the priority setting in correspondence with frequency of appearance, is selected based on the user's selection.

When the priority setting in correspondence with paper color is performed, a priority setting table is generated based on settings as shown in e.g. FIG. 20A. Further, when the priority setting in correspondence with paper quality is performed, a priority setting table is generated based on settings as shown in e.g. FIG. 20B.

FIGS. 21A to 21C show an example of the priority setting table generated as above. FIG. 21A illustrates an example of the priority setting table when a priority is placed on frequency of appearance; FIG. 21B illustrates an example of the priority setting table when a priority is placed on paper color; and FIG. 21C illustrates an example of the priority setting table when a priority is placed on paper quality.

[Modification]

In the above-described exemplary embodiments, a paper change instruction is issued such that paper of a paper type with a higher priority is not changed for paper of a paper type with a lower priory. However, the present invention is not limited to this arrangement. It may be arranged such that paper change control is performed based on another algorithm.

For example, it may be arranged such that when paper of a designated paper type is not set in the paper feeding device, the paper change instruction part 36 issues an instruction to change paper of a paper type without priority for paper of the designated paper type.

Further, it may be arranged such that when paper of a designated paper type is not set in the paper feeding device, the paper change instruction part 36 issues an instruction to change paper of a paper type with a lower priority than the designated paper type for paper of the designated paper type.

Further, it may be arranged such that the output control information extraction part 34 extracts paper type information designated for a subsequent page in a corresponding print instruction based on output control information included in the print job received by the print job reception part 31, and when paper of a designated paper type is not set in the paper feeding device 17, the paper change instruction part 36 issues an instruction to change paper of a paper type not designated for the subsequent page for paper of the designated paper type based on the information extracted by the output control information extraction part 34.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a paper feeding device that supplies paper;

a reception unit that receives a print instruction including output control information in which a paper type is designated by page;

a setting unit that sets a priority in paper change by paper type based on the output control information included in the print instruction received by the reception unit;

an instruction unit that issues a paper change instruction based on the priority set by the setting unit; and a printing device that performs printing on paper of a type designated by the instruction unit, wherein when paper of a designated paper type is not set in the paper feeding device, the instruction unit issues an instruction to change paper of a paper type other than a paper type in higher priority than a priority of the designated paper type for the paper of the designated paper type, and wherein the setting unit sets final page information by paper type based on the output control information included in the print instruction received by the reception unit, and the instruction unit issues an instruction to handle paper of a paper type for which print processing for a final page has been completed as paper to be changed.

2. The image forming apparatus according to claim 1, wherein when paper of a designated paper type is not set and the number of paper types designated in the print instruction is larger than the number of paper types settable in the paper feeding device, and further, when paper of a paper type with a lower priority than a priority of the designated paper type is set, the instruction unit issues an instruction to feed the paper of the designated paper type to a particular paper feed position.

3. The image forming apparatus according to claim 1, further comprising:

a generation unit that generates a paper change procedure based on the priority set by the setting unit; and an output unit that prints an instruction document indicating the paper change procedure generated by the generation unit.

4. The image forming apparatus according to claim 1, wherein when paper of a designated paper type is not set in the paper feeding device, the instruction unit issues an instruction to change paper of a paper type without priority with the paper of the designated paper type.

5. The image forming apparatus according to claim 1, wherein when paper of a designated paper type is not set in the paper feeding device, the instruction unit issues an instruction to change paper of a paper type with a lower priority than a priority of the designated paper type for the paper of the designated paper type.

6. An image forming apparatus according to claim 1, further comprising:

an extraction unit that extracts information on the paper type designated for a subsequent page in the print instruction, based on the output control information included in the print instruction received by the reception unit; and an instruction unit that, when paper of a designated paper type is not set in the paper feeding device, issues an instruction to change paper of a paper type not designated in the subsequent page for the paper of the designated paper type based on the information extracted by the extraction unit.

7. The image forming apparatus according to claim 1, wherein the setting unit sets the priority in correspondence with the number of pages by paper type.

8. The image forming apparatus according to claim 1, wherein the setting unit sets the priority in correspondence with paper color.

9. The image forming apparatus according to claim 1, wherein the setting unit sets the priority in correspondence with paper quality.

10. The image forming apparatus according to claim 1, wherein the setting unit sets the priority in correspondence with frequency of appearance by paper type upon execution of the print instruction.

11. An image forming system comprising:

a print instruction device having a transmission unit that transmits a print instruction including output control information in which a paper type is designated by page; and an image forming apparatus having:

a paper feeding device that supplies paper;

a reception unit that receives the print instruction from the print instruction device;

a setting unit that sets a priority in paper change by paper type and final page information by paper type, based on the output control information included in the print instruction received by the reception unit;

an instruction unit that issues a paper change instruction based on the priority set by the setting unit; and a printing device that performs printing on paper of a paper type designated by the instruction unit, wherein when paper of a designated paper type is not set in the paper feeding device, the instruction unit issues the paper change instruction to change paper of a paper type other than a paper type in higher priority than a priority of the designated paper type for the paper of the designated paper type, and to handle paper of a paper type for which print processing for a final page has been completed as paper to be changed.

12. A non-transitory computer readable medium storing a program causing a computer to execute a process for image formation, the process comprising:

receiving a print instruction including output control information in which a paper type is designated by page;

setting a priority in paper change by paper type and final page information by paper type, based on the output control information included in the received print instruction;

issuing a paper change instruction based on the priority set at the setting step; and supplying designated paper and performing printing, wherein when paper of a designated paper type is not set in the paper feeding device, the paper change instruction is issued to change paper of a paper type other than a paper type in higher priority than a priority of the designated paper type for the paper of the designated paper type, and to handle paper of a paper type for which print processing for a final page has been completed as paper to be changed.

13. An image forming method comprising:

receiving a print instruction including output control information in which a paper type is designated by page;

setting a priority in paper change by paper type and final page information by paper type, based on the output control information included in the received print instruction;

issuing a paper change instruction based on the priority set at the setting step; and supplying designated paper and performing printing, wherein when paper of a designated paper type is not set in the paper feeding device, the paper change instruction is issued to change paper of a paper type other than a paper type in higher priority than a priority of the designated paper type for the paper of the designated paper type, and to handle paper of a paper type for which print processing for a final page has been completed as paper to be changed.

* * * * *